United States Patent [19]

Brown

[11] 4,209,677

[45] Jun. 24, 1980

[54] PRECISION SNAP SWITCH WITH IMPROVED ONE PIECE CONTACT SUPPORT AND TERMINAL MEMBER

[75] Inventor: Harry W. Brown, Big Bend, Wis.

[73] Assignee: Eaton Corporation, Cleveland, Ohio

[21] Appl. No.: 20,824

[22] Filed: Mar. 15, 1979

[51] Int. Cl.[2] ..... H01H 5/22

[52] U.S. Cl. ..... 200/67 D; 200/284

[58] Field of Search ..... 200/67 D, 284, 303; 74/100 P

[56] References Cited

U.S. PATENT DOCUMENTS

| | | | |
|---|---|---|---|
| 2,182,856 | 12/1939 | Richie | 74/100 P |
| 2,358,658 | 9/1944 | Richie et al. | 200/67 D |
| 2,468,512 | 4/1949 | Richie | 200/67 D |
| 2,469,686 | 5/1949 | Eaton | 200/67 D |
| 2,526,850 | 10/1950 | Charbonneau | 200/67 D X |
| 2,582,034 | 1/1952 | Hausler | 200/67D |
| 2,681,964 | 6/1954 | Rodden | 200/303 X |
| 2,755,353 | 7/1956 | Bachi | 200/67 D |
| 3,061,694 | 10/1962 | Carlson | 200/67 D |
| 3,883,705 | 5/1975 | Sebastian et al. | 200/303 X |
| 4,072,839 | 2/1978 | Spedale | 200/303 X |

FOREIGN PATENT DOCUMENTS

| | | | |
|---|---|---|---|
| 564975 | 10/1944 | United Kingdom | 200/67 D |
| 609680 | 10/1948 | United Kingdom | 200/67 D |
| 726902 | 3/1955 | United Kingdom | 200/67 D |
| 765474 | 1/1957 | United Kingdom | 200/67 D |

*Primary Examiner*—Stephen Marcus

*Attorney, Agent, or Firm*—Hugh R. Rather; William A. Autio

[57] ABSTRACT

Precision snap switches having improved forms of integral one piece contact support and wire terminal members that reduce electrical heating, enhance the current carrying ratings of such switches, and facilitate the use of larger size wire terminal securing screws.

5 Claims, 7 Drawing Figures

PRECISION SNAP SWITCH WITH IMPROVED ONE PIECE CONTACT SUPPORT AND TERMINAL MEMBER

BACKGROUND OF THE INVENTION

Precision snap acting switches employing stressed, movable snap members for completing and interrupting electrical circuits are of course well known. Present day designs of such switches typically employ tubular rivets or molded in inserts extending through their mounting bases to provide securement of stationary contacts and terminal members to the base and provide electrical circuit between them and threaded wire terminal screws mounted on an opposite side of the base. Such construction results in electrical joints which if they are not initially firmly secured or otherwise become distorted or loosened in the switch assembly process cause unwanted heating. Such heating necessarily acts as a limitation on the current ratings of such switches. Also such type of construction limits the size of wire terminal securing screws that can be used on such switches thereby making field wiring somewhat difficult.

OBJECT OF THE INVENTION

It is a primary object of the invention to provide an improved terminal and snap blade and contact support construction for precision snap switches which is characterized by a considerable reduction in heat generating electrical joints in facilitating use of larger size wire to terminal securing screws.

A more particular object is to provide such improved construction by employing integral, one piece members which serve both as contact supports and terminal members without any intervening electrical joints.

Other objects and advantages of the invention will hereinafter appear.

BRIEF DESCRIPTION OF THE DRAWINGS

Referring to FIGS. 1 to 3 they show a preferred form of normally closed snap-action switch constructed in accordance with the invention. More particularly it comprises a base 10, a cover 12, a combination terminal and pivot member 14, contact-terminal member 16, contact blade 18, and an operating plunger 20.

Figure 3:
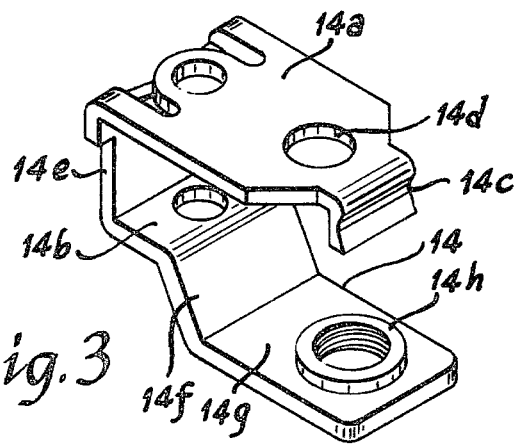
FIG. 3 is a view in perspective of a contact-terminal member in the switch of FIG. 1.

The base 10 is preferably formed from a phenolic molding material having high electrical insulating characteristics. The terminal-pivot member 14 which is preferably of the form shown in FIG. 3 and formed of brass is secured to the base 10 by a rivet 22 which extends through aligned opening in the upper and lower limbs **14*a* and 14*b* the member 18 and base 10. The member 14 has a down turned fulcrum portion 14*c* that is integral with the upper limb 14*a*. The outer surface of portion 14*c* is provided with a fulcrum socket of a shallow V-shaped form having a substantially flat apex in which seats the end of the bowed intermediate finger 18*a* of the contact blade 18**. Such fulcrum socket is preferably like that shown and described in the Richie U.S. Pat. No. 2,182,856.

The left hand end of the blade 18 is secured against the upper side of the boss **10*a* of base 10 by the rivet 22 and upper limb 14*a*. Limb 14*a* is provided with a clearance opening 14*d* to accommodate a convex hemispherical dimple 18*b* formed on the blade 18 and the lower end 20*a* plunger 20 which bears at its lower end against the dimple 18*b***.

Figure 1:
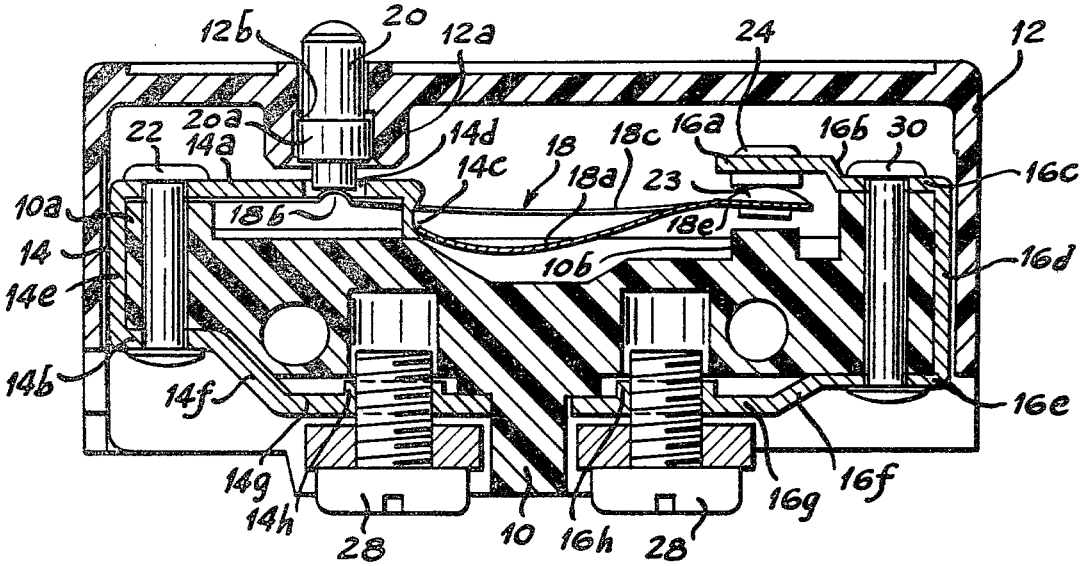
FIG. 1 is a view in longitudinal cross section of an electric switch constructed in accordance with the invention.
Figure 4:
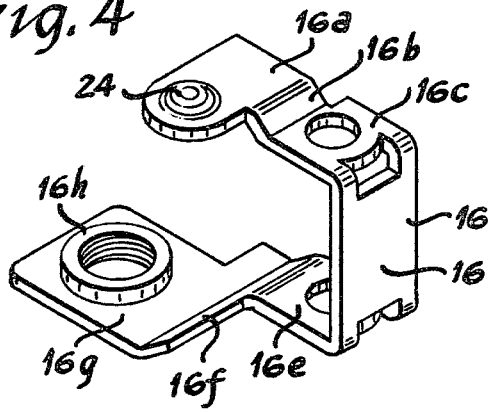
FIG. 4 is a view like FIG. 3 of another contact-terminal member in the switch of FIG. 1.

It may be assumed that member 18 has finger portions like the portion **18*c* which lie on opposite side of the bowed finger 18*a*. The finger 18*a*, 18*c* and the other thereto merge into an integral right hand end portion 18*e* in which is fixed an electrical contact 23. Contact 23 in the operating position of the switch shown in FIG. 1 bears against the stationary electrical contact 24 secured in the upper limb 16*a* of a terminal member 16 which is of the form best shown in FIG. 4. The form of the blade 18** is preferable similar to that shown in the Millard U.S. Pat. No. 2,627,754.

The upper and lower limbs **14*a* and 14*b* of terminal 14 are interconnected by the integral portion 14*e* which abuts against the left hand end of the base 10. The lower limb portion 14*b* is integrally connected with a portion 14*f* that extends at an angle downwardly therefrom and bears against a complementally angled surface on base 10. The portion 14*f* in turn is integrally connected with a portion 14*g* that is generally parallel with the upper limb 14*a*. Portion 14*g* has a threaded boss 14*h* which receives the wire terminal securing screw 28. The right hand end of the portion 14*g* seats on a shoulder formed on the base 10**.

The upper limb **16*a* of terminal 16 merges with a short portion 16*b* that angles downwardly and in turn merges with a horizontal portion 16*c*. The portion 16*c* integrally connects with the portion 16*d* that extends downwardly therefrom at a right angle and bears against the right hand end of base 10. At its lower end portion 16*d* integrally connects with the portion 16*e*. Portion 16*e* integrally connects with a portion 16*f* that angles downwardly and connects with the lowermost portion 16*g*. A threaded boss 16*h* is formed on the portion 16*g* and receives another wire terminal securing screw 28. A rivet 30 which penetrates aligned openings in the portions 16*c* and 16*e* of terminal 16 and in the base 10 secure the terminal 16** on the base.

Figure 2:
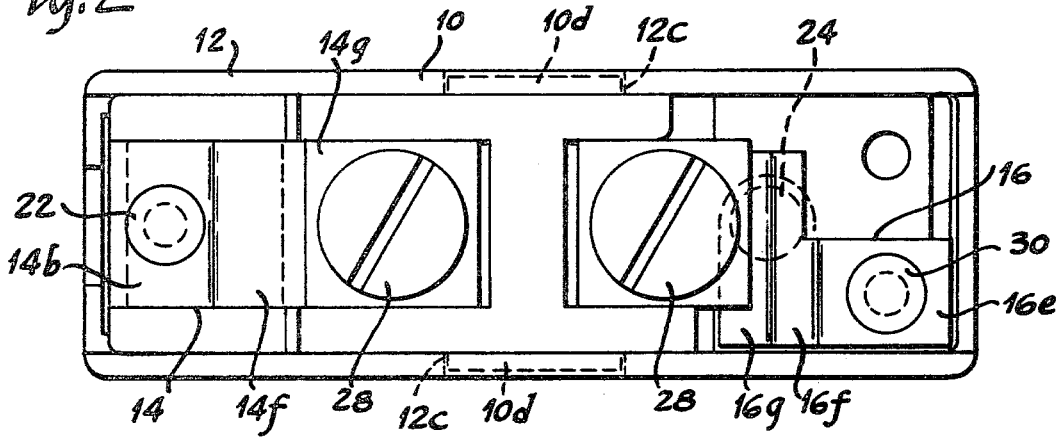
FIG. 2 is a bottom plan view of the switch of FIG. 1

The cover 12 is provided with an internal downwardly extending boss portion **12*a* in which is provided with an enlarged recess 12*b* in which slides an enlarged cylindrical portion 20*a* of operating plunger 20. The upper shoulder of the portion 20*a* abuts against the inner end of recess 12*b* to limit the outward movement of plunger 20. The lower shoulder of portion 20*a* abuts against the upper surface of portion 14*a* of member 14 to prevent overstressing of contact blade 18 when plunger 20 is pushed downwardly beyond the normal overtravel needed to assure that blade 18 moves past its overcenter snap position. As best shown in FIG. 2 the cover 12 is secured in place on the base 10 by rectangular projections 10*d* which interfit within complementally formed openings 12*c*** in the cover.

If plunger 20 is depressed inwardly of cover 12 the blade 18 will move downwardly and the blade fingers 18*c* and 18*d*, move with snap action in a well known manner downwardly to separate the contact 23 from stationary contact 24. The bottom surface of contact 23 will then bear against the end of the upwardly extending boss 10*b* formed on base 10 which acts as a limit stop. If plunger 20 is thereafter released, member 18 being of the astable type will then automatically return with snap action to the operating and contact closed position depicted in FIG. 1.

The important aspects of the present invention reside in the relatively few number of parts and consequent minimization of electrical joints provided by the terminal members 14 and 16. As described they are of integral construction and the only electrical joints made therewith are the terminal screws 28, the blade 18 with member 14 and the stationary contact 24 with terminal 16. Accordingly heat rise due to joint resistance is reduced, and consequently the amperage rating of the switch will be enhanced.

Figure 5:
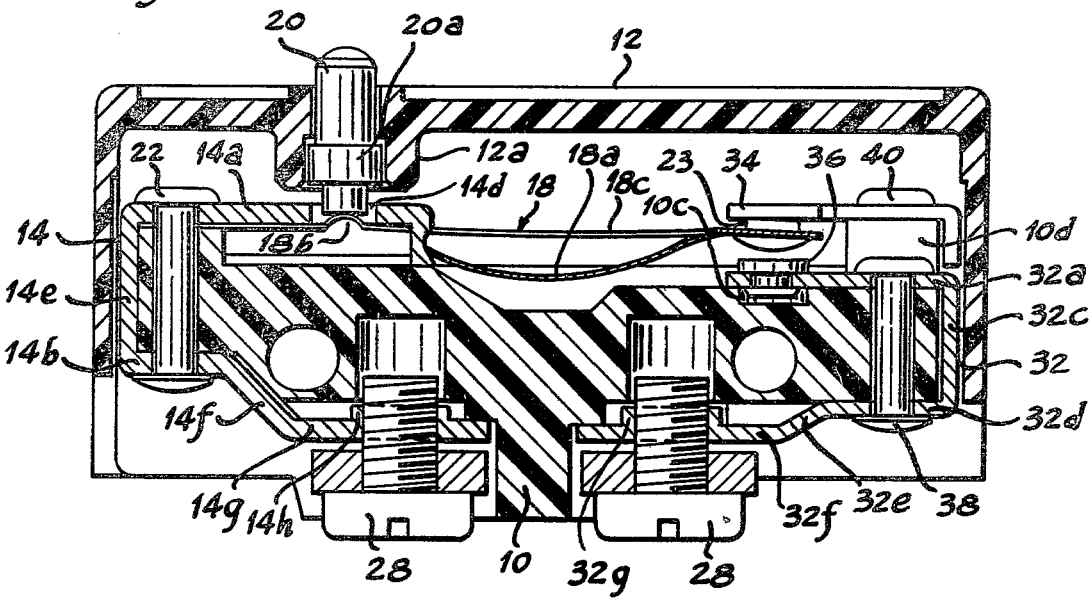
FIG. 5 is a view like FIG. 1 of a modified form of switch constructed in accordance with the invention.
Figure 6:
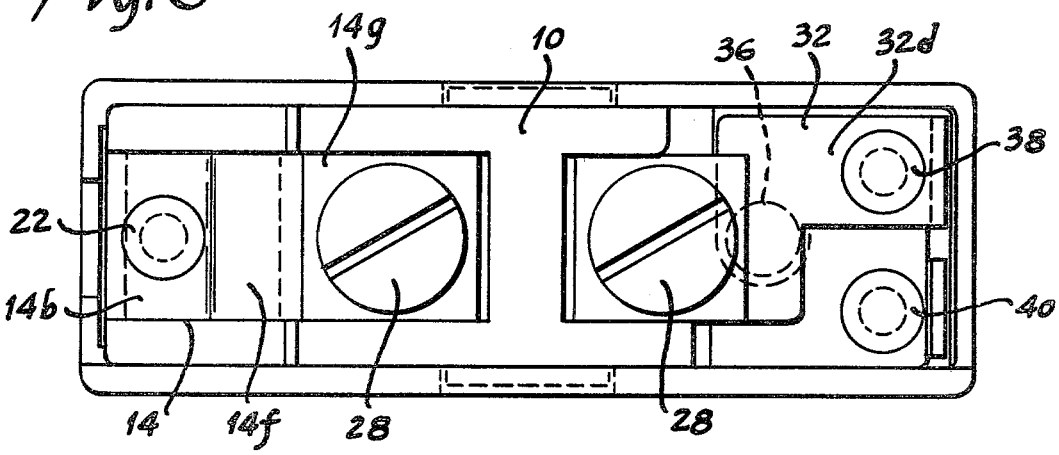
FIG. 6 is a bottom plan view of the modified form of switch of FIG. 5.
Figure 7:
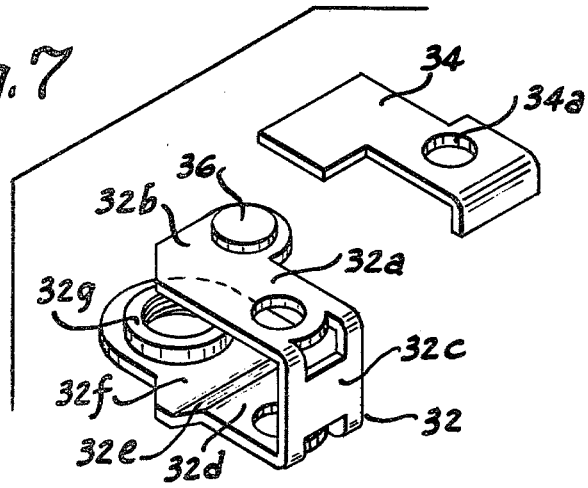
FIG. 7 is a perspective view of a contact-terminal member and stop member used in the modified form of switch.

FIGS. 5 to 7 disclose a modified form of switch affording normally open type of switch construction. Parts which are the same as the embodiment of FIGS. 1 to 4 bear identical reference numerals. In this modified version a terminal member 32 and a stop plate 34 take the place of terminal member 16. The base 10 is slightly altered with the boss 10*b* being removed and a recess 10*c* provided in its place.

As best shown in FIGS. 5 & 7, terminal 32 is provided with an upper limb 32*a* that seats on an upper surface of base 10 and merges with a right angle extending stub portion 32*b* in which is fixed a stationary contact 36. At its opposite end the portion 32*a* merges with a portion 32*c* that extends downwardly at a right angle adjacent the right hand end of base 10. The portion 32*c* in turn merges with a portion 32*d* that abuts a lower surface on base 10, and the later portion in turn merges with a portion 32*e* that extends at an angle downwardly and merges with the portion 32*f*. An integral threaded boss portion 32*g* is formed on the portion 32*f* and receives a threaded wire terminal securing screw 28. Terminal 32 is secured on base 10 by a rivet 38 that penetrates aligned openings in the portions 32*a* and 32*d* and the base 10.

The stop plate 34 is of the form best shown in FIG. 7 and is secured to the upper end of the raised portion 10*d* of base 10 by a rivet 40 that penetrates the opening 34*a* in the plate and an aligned opening in base 10. The plate 34 is thus electrically insulated from the terminal 32.

In the operating position of the switch depicted in FIG. 5, contact 23 bears against the lower surface of stop plate 34 so that the current between terminals 14 and 32 is interrupted. Depressing plunger 20 will result in member 18 moving with snap action to cause contact 23 to complete an electrical circuit between terminal members 14 and 32 through member 18. Release of plunger 20 will of course cause member 18 and contact 23 to return to the normally open position depicted in FIG. 5.

I claim:

1. In a precision snap switch having a movable contact blade mounted and stressed for self movement to a normal stable position from which it is actuatable with snap action to another position, in combination, a molded insulating base having opposite sides and ends, a one piece snap blade support and terminal member secured to and straddling the opposite sides of said base at one end thereof, said member overlying a portion of said contact blade at one side of said base and providing a snap pivot fulcrum for another portion of such blade, and a one piece combination stationary contact and terminal member straddling said opposite sides of said base at the other end thereof.

2. The combination according to claim 1 wherein each of said one piece members have integral bight portions overlying the respective ends of said base that connect their portions that straddle said opposite sides of said base, and wherein wire securing terminal screws are threadingly mounted in each of said one piece members on corresponding sides of said base opposite said one side thereof.

3. The combination according to claim 1 wherein said stationary contact support and terminal member has a contact supporting portion which is spaced apart from said one side of said base with which said contact blade engages when in its normal position.

4. The combination according to claim 1 together with a stop member secured to said base in spaced relations to a contact mounted on said stationary contact support and terminal member and serving to limit the movement of said contact blade when actuated out of its normal stable position.

5. The combination according to claim 1 together with a cover formed of an insulating material which has a snap-on fit with said base which it encloses on all sides except the other of said opposite sides, and an axially rotatable actuator plunger extending through openings in said cover, and said portions of said contact blade and said overlying blade support and terminal member and engaging at a flat end surface with a convex hemispherical dimple formed on said portion of said blade.

* * * * *